US009727020B2

(12) United States Patent
Kadowaki

(10) Patent No.: US 9,727,020 B2
(45) Date of Patent: Aug. 8, 2017

(54) DEVELOPER CONVEYANCE DEVICE INCLUDING SPIRAL COIL, AND IMAGE FORMING DEVICE INCLUDING THE DEVELOPER CONVEYANCE DEVICE

(71) Applicant: Sharp Kabushiki Kaisha, Osaka-shi, Osaka (JP)

(72) Inventor: Hideaki Kadowaki, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 14/641,552

(22) Filed: Mar. 9, 2015

(65) Prior Publication Data

US 2015/0268585 A1 Sep. 24, 2015

(30) Foreign Application Priority Data

Mar. 20, 2014 (JP) ..... 2014-057898

(51) Int. Cl.
*G03G 21/10* (2006.01)
*G03G 15/22* (2006.01)

(52) U.S. Cl.
CPC ... *G03G 21/105* (2013.01); *G03G 2215/0132* (2013.01)

(58) Field of Classification Search
CPC ..... G03G 15/0844; G03G 15/0839
USPC ..... 399/358, 263
See application file for complete search history.

(56) References Cited

U.S. PATENT DOCUMENTS 5,619,312 A * 4/1997 Hatano ..... G03G 15/0822 399/263
2005/0002708 A1* 1/2005 Jeong et al. ..... 399/358
2005/0196207 A1* 9/2005 Matsuyama ..... G03G 21/105 399/358
2009/0238617 A1* 9/2009 Nakatake ..... G03G 21/12 399/358
2010/0189483 A1* 7/2010 Inoue ..... 399/358
2010/0290814 A1 11/2010 Morimoto et al.
2011/0318049 A1* 12/2011 Suzuki ..... 399/101
2015/0117909 A1* 4/2015 Shimizu et al. ..... 399/263
2015/0132027 A1* 5/2015 Kashimoto et al. ..... 399/254
2015/0234341 A1* 8/2015 Teraji ..... G03G 21/0029 399/358

FOREIGN PATENT DOCUMENTS

JP 07-114301 A 5/1995
JP 2001-109343 A 4/2001
JP 2007-010921 A 1/2007
JP 2009008852 A * 1/2009
JP 2010-266546 A 11/2010
JP 2011-242576 A 12/2011

* cited by examiner

*Primary Examiner* — Walter L Lindsay, Jr.
*Assistant Examiner* — Arlene Heredia Ocasio
(74) *Attorney, Agent, or Firm* — Keating & Bennett, LLP

(57) ABSTRACT

In a developer conveyance device, a spiral screw is arranged inside a spiral coil such that the spiral coil and the spiral screw are both rotated. Accompanied by rotation of the spiral coil, even if waste toner tries to pass through the spiral coil and move in a vertical direction, movement of the waste toner in the vertical direction is blocked by the spiral screw, such that the waste toner is conveyed by the spiral screw. Since the waste toner hardly passes through the spiral coil in the vertical direction, the waste toner is also conveyed by the spiral coil.

5 Claims, 13 Drawing Sheets

DEVELOPER CONVEYANCE DEVICE INCLUDING SPIRAL COIL, AND IMAGE FORMING DEVICE INCLUDING THE DEVELOPER CONVEYANCE DEVICE

BACKGROUND OF THE INVENTION

1. Field of the Invention

The present invention relates to a developer conveyance device configured to convey powdery developer and to an image forming device.

2. Description of the Related Art

In an image forming device using an electrophotographic method, for example, a surface of a photoreceptor (image carrier) is uniformly charged, the surface of the photoreceptor is scanned with a light beam, an electrostatic latent image is formed on the surface of the photoreceptor, the electrostatic latent image on the surface of the photoreceptor is developed by toner (developer), an toner image is formed on the surface of the photoreceptor, and the toner image is transferred from the surface of the photoreceptor to recording paper. Furthermore, immediately after the toner image has been transferred, the surface of the photoreceptor is cleaned by a cleaning device by removing the toner remaining on the surface of the photoreceptor, and the removed toner is conveyed to a container where it is recovered.

For example, in JP 2007-10921 A, a toner conveyance coil is arranged inside a toner recovery unit and a toner conveyance pipe and is rotated. Toner is conveyed from the toner recovery unit to the toner conveyance pipe by the toner conveyance coil, and the toner is discharged from a discharge opening at an end portion of the toner conveyance pipe. Furthermore, the toner conveyance coil is vibrated by being hooked to an interference member provided on an inner periphery of the toner conveyance pipe, such that the toner adhered to an inner wall of the toner conveyance pipe is shaken off.

In JP 2001-109343 A, a coil auger is arranged inside a pipe and is rotated. Toner is dropped on the coil auger through an opening at one end portion of the pipe, the toner is conveyed inside the pipe by the coil auger, and the toner is discharged to a waste toner recovery container from a discharge opening at the other end portion of the pipe.

Further, in JP 7-114301 A, a coil spring is arranged inside a toner conveyance path and is rotated in order to convey toner inside of the toner conveyance path. Solidification of the toner is prevented by changing a pitch and a diameter of the coil spring according to a position of the coil spring in a lengthwise direction, by providing another coil spring inside the coil spring and rotating two coil springs, or by inserting a shaft inside the coil spring and providing a projection on an outer periphery of the shaft.

In JP 2007-10921 A, the toner is naturally dropped on the toner conveyance coil through the toner recovery unit. However, since an upper side of the toner conveyance coil is opened in the toner recovery unit, when the toner conveyance coil is rotated, the toner easily moves in a vertical direction and passes through the toner conveyance coil, such that a toner conveyance performance when using the toner conveyance coil is decreased. Accordingly, when an amount of toner is large, the toner may be accumulated and solidified.

In JP 2001-109343 A as well, the toner is dropped on the coil auger through the opening at one end portion of the pipe. However, at the opening, since an upper side of the coil auger is opened, when the coil auger is rotated, the toner easily moves in the vertical direction and passes through the coil auger, such that a toner conveyance performance when using the coil auger is decreased. When the amount of toner is large, the toner may be accumulated and solidified.

Further, in JP 7-114301 A, the pitch and the diameter of the coil spring is changed. However, in a portion where the toner is naturally dropped, when the coil spring is rotated, the toner easily moves in the vertical direction and passes through the coil spring, such that a toner conveyance performance when using the coil spring is decreased. When the amount of the toner is large, it is considered that the toner is accumulated and solidified.

In JP 7-114301 A, another coil spring is provided inside the coil spring. However, in a portion where the toner is naturally dropped, the toner passes through two coil springs in the vertical direction, such that the toner hardly moves in a direction of conveyance. When the amount of the toner is large, it is considered that the toner is accumulated and solidified.

Further, in JP 7-114301 A, the projection is provided on the outer periphery of the shaft inside the coil spring. However, the shaft itself has no toner conveyance performance, such that in a portion where the toner is naturally dropped, the toner conveyance performance when using the coil spring becomes insufficient. When the amount of toner is large, it is considered that the toner is accumulated and solidified.

Further, in any of JP 2007-10921 A, JP 2001-109343 A, and JP 7-114301 A, when the solidification of the toner progresses, the toner conveyance coil, the coil auger, and the coil spring are elastically deformed being buried in the toner, such that the toner conveyance performance is decreased, and the solidification of the toner cannot be sufficiently prevented. It is not possible to solve this problem by providing another coil spring inside the coil spring as in JP 2001-109343 A or by providing a shaft inside the coil spring.

SUMMARY OF THE INVENTION

Therefore, preferred embodiments of the present invention provide a developer conveyance device and an image forming device capable of surely conveying developer even in a portion where the toner is naturally dropped and capable of preventing solidification of the developer.

A developer conveyance device according to a preferred embodiment of the present invention includes a spiral coil provided in a conveyance path of the developer and configured to convey the developer by rotating; a shaft member passing through and attached to an end portion of the spiral coil and rotatably supporting the end portion of the spiral coil; and a spiral screw provided on an outer periphery of the shaft member and inside of the spiral coil.

The shaft member preferably is passed through and is attached to the end portion of the spiral coil, and the end portion of the spiral coil is rotatably supported by the shaft member. Thus, when the spiral coil or the shaft member is rotary driven, the spiral coil and the shaft member are rotated. Since the spiral screw is provided on the outer periphery of the shaft member and inside the spiral coil, when the spiral coil or the shaft member is rotated, the spiral screw inside the spiral coil is also rotated. Accordingly, in a situation where an upper portion of the shaft member is opened, accompanied by rotation of the spiral coil, even if the developer tries to pass through the spiral coil and to move in the vertical direction, movement of the developer in the vertical direction is blocked by the spiral screw inside the spiral coil such that the developer is conveyed by the spiral screw. Since the developer hardly passes through the spiral coil in the vertical direction, the developer is also conveyed by the spiral coil. That is, the developer is surely conveyed by the spiral screw and the spiral coil. In a situation where the solidification of the developer is progressing, even if the spiral coil is elastically deformed by being buried in the developer, the spiral screw is not elastically deformed. As a result, a developer conveyance performance when using the spiral screw is maintained, and the solidification of the developer is effectively prevented.

The conveyance path preferably is a tubular member through which the spiral coil is passed, and the tubular member is provided with an opening in a portion where there is the shaft member.

In this way, in a case where the spiral coil is passed through the tubular member, which is the conveyance path, the developer inside the conveyance path is efficiently conveyed by the spiral coil. At the opening of the tubular member, the developer may be moved more easily in the vertical direction. However, as described above, the movement of the developer in the vertical direction is blocked by the spiral screw inside the spiral coil such that the developer is conveyed by the spiral screw. Since the developer hardly passes through the spiral coil in the vertical direction, the developer is also conveyed by the spiral coil. Thus, at the opening of the tubular member as well, the developer is surely conveyed by the spiral screw and the spiral coil.

The spiral screw preferably extends in a direction of conveyance of the developer relative to the opening of the tubular member.

In this case, the developer is surely conveyed from the opening to inside the tubular member by the spiral screw.

A pitch of the spiral coil at the opening preferably is shorter than a pitch of the spiral screw.

In this case, since the spiral coil and the spiral screw are integrally rotated, a conveyance speed of the developer by the spiral screw becomes faster than a conveyance speed of the developer by the spiral coil, such that at the opening, the developer is more surely conveyed by the spiral screw. Due to a difference between the conveyance speed by the spiral screw and the conveyance speed by the spiral coil, it is possible to effectively prevent the solidification of the developer.

According to another preferred embodiment of the present invention, a developer conveyance device includes a spiral coil provided in a conveyance path of the developer and configured to convey the developer by rotating; a shaft member passed through and attached to a spiral coil; and a spiral screw provided on an outer periphery of the shaft member and inside the spiral coil.

The shaft member preferably is passed through and is attached to the spiral coil. Since the spiral screw is provided on the outer periphery of the shaft member and inside the spiral coil, when the spiral coil and the shaft member are rotated, the spiral screw inside the spiral coil is also rotated. Accordingly, accompanied by rotation of the spiral coil, even if the developer tries to pass through the spiral coil and to move in the vertical direction, movement of the developer in the vertical direction is blocked by the spiral screw inside the spiral coil such that the developer is conveyed by the spiral screw. Since the developer hardly passes through the spiral coil in the vertical direction, the developer is also conveyed by the spiral coil. That is, the developer is surely conveyed by the spiral screw and the spiral coil. Furthermore, in a situation where the solidification of the developer is progressing, even if the spiral coil is elastically deformed by being buried in the developer, the spiral screw is not elastically deformed. As a result, the developer conveyance performance by the spiral screw is maintained, and the solidification of the developer is effectively prevented.

A pitch of the spiral coil preferably is shorter than a pitch of the spiral screw.

In this case, since the spiral coil and the spiral screw are integrally rotated, the conveyance speed of the developer by the spiral screw becomes faster than the conveyance speed of the developer by the spiral coil, such that it is possible to effectively prevent the solidification of the developer due to a difference between these conveyance speeds.

On the other hand, the image forming device according to a preferred embodiment of the present invention is provided with the above-described developer conveyance device according to another preferred embodiment of the present invention.

With this image forming device according to a preferred embodiment of the present invention as well, the same function and effect as the above-described developer conveyance device of other preferred embodiments of the present invention are obtained.

In various preferred embodiments of the present invention, the shaft member is passed through and is attached to the end portion of the spiral coil, and the end portion of the spiral coil is rotatably supported by the shaft member. Thus, when the spiral coil or the shaft member is rotary driven, the spiral coil and the shaft member are rotated. Since the spiral screw is provided on the outer periphery of the shaft member and inside the spiral coil, when the spiral coil and the shaft member are rotated, the spiral screw inside the spiral coil is also rotated. Accordingly, in a situation where the upper side of the shaft member is opened, accompanied by the rotation of the spiral coil, even if the developer tries to pass through the spiral coil and to move in the vertical direction, movement of the developer in the vertical direction is blocked by the spiral screw inside the spiral coil, such that the developer is conveyed by the spiral screw. Since the developer hardly passes through the spiral coil in the vertical direction, the developer is also conveyed by the spiral coil. That is, the developer is surely conveyed by the spiral screw and the spiral coil. In a situation where the solidification of the developer is progressing, even if the spiral coil is elastically deformed by being buried in the developer, the spiral screw is not elastically deformed. As a result, the developer conveyance performance by the spiral screw is maintained, and the solidification of the developer is effectively prevented.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 6 is a perspective view illustrating the partially broken waste toner receiving unit, the conveyance hose, and the like.

DETAILED DESCRIPTION OF THE PREFERRED EMBODIMENTS

Hereinafter, preferred embodiments of the present invention are described based on the drawings.

First Preferred Embodiment

Figure 1:
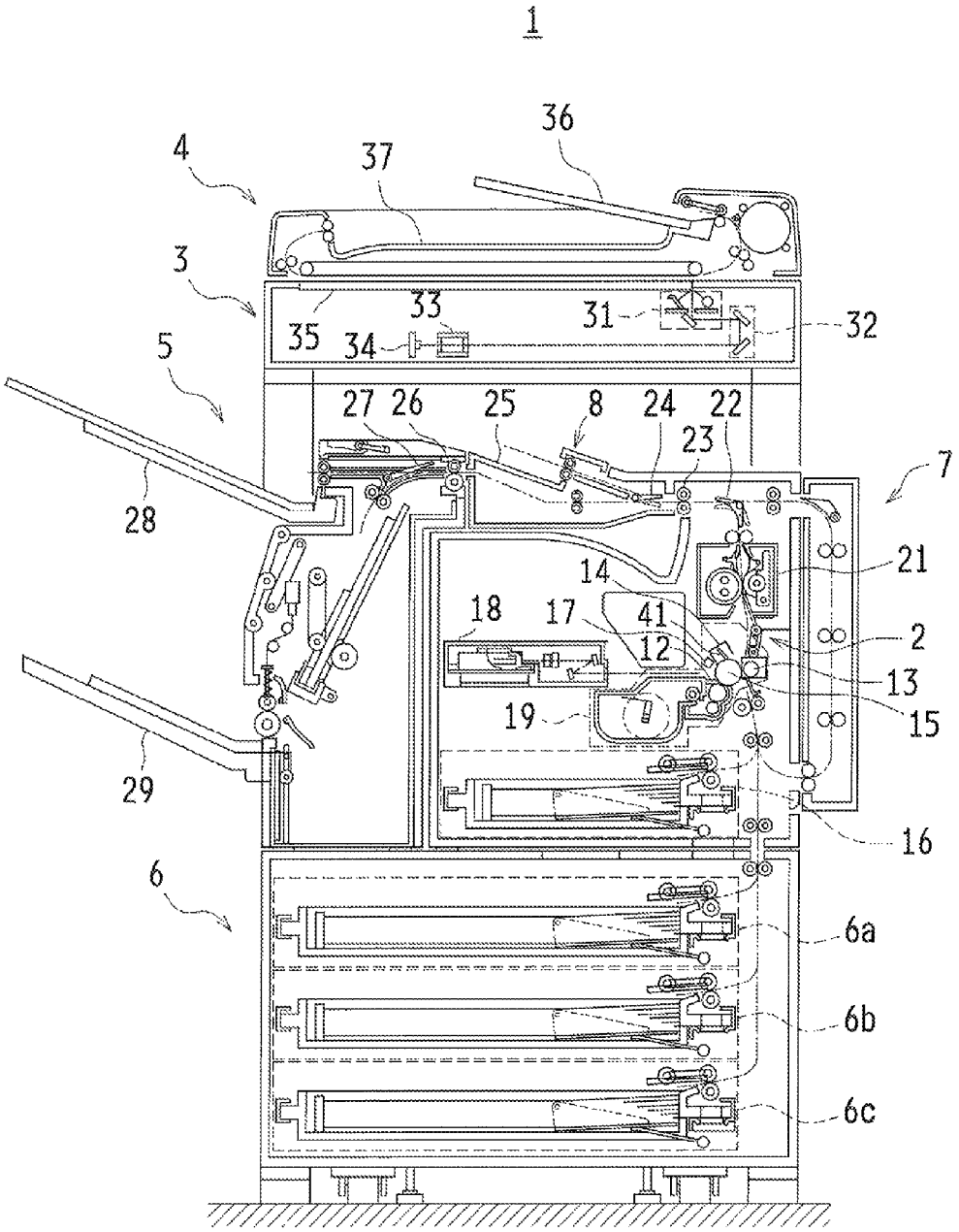
FIG. 1 is a sectional view illustrating an image forming device, to which a developer conveyance device of a first preferred embodiment of the present invention is applied, viewed from a front side.

FIG. 1 is a sectional view illustrating an image forming device, to which a developer conveyance device of a first preferred embodiment of the present invention is applied, viewed from a front side. An image forming device 1 preferably is configured by combining a printing unit 2, an image reading device 3, an original conveyance device 4, a post-processing device 5, a paper supply device 6, a double-sided conveyance device 7, and the like.

The printing unit 2 preferably is configured by arranging a charging device 17, an optical scanning device 18, a developing device 12, a transfer device 13, a cleaning device 14, a discharging lamp device (not illustrated), and the like around a photoreceptor drum 15. Furthermore, the photoreceptor drum 15, the charging device 17, the developing device 12, the transfer device 13, the cleaning device 14, and the discharging lamp device are preferably incorporated into one cartridge 19 as a unit, such that replacement by the cartridge 19 is possible.

In this printing unit 2, a surface of the photoreceptor drum 15 is uniformly charged by the charging device 17. The surface of the photoreceptor drum 15 is scanned by the optical scanning device 18, and an electrostatic latent image is written on the surface of the photoreceptor drum 15. Then, toner (developer) is applied to the electrostatic latent image on the surface of the photoreceptor drum 15 by the developing device 12. The electrostatic latent image on the surface of the photoreceptor drum 15 is developed to form a toner image, and the toner image is transferred from the surface of the photoreceptor drum 15 to recording paper by the transfer device 13. Further, the toner remaining on the surface of the photoreceptor drum 15 is removed by the cleaning device 14. The surface of the photoreceptor drum 15 is cleaned, and an electric charge on the surface of the photoreceptor drum 15 is removed by the discharging lamp device (not illustrated).

Furthermore, a paper supply unit 16 is arranged below the printing unit 2, and further below the paper supply unit 16, the paper supply device 6 is provided. The paper supply device 6 preferably includes three paper supply units 6*a*, 6*b*, and 6*c*, for example. A plurality of recording paper is stacked and housed in each of the paper supply units 16, 6*a*, 6*b*, and 6*c*. The recording paper is drawn out one sheet by one sheet from any of the paper supply units 16, 6*a*, 6*b*, and 6*c* and is supplied to the printing unit 2. The recording paper is conveyed to a nip zone between the photoreceptor drum 15 and the transfer device 13 where the toner image formed on the surface of the photoreceptor drum 15 is transferred thereon. Here, during operation of the image forming device 1, any of the paper supply units 16, 6*a*, 6*b*, and 6*c* in which the recording paper of a desired size is housed is selectively operated. The recording paper is conveyed and supplied to the nip zone between the photoreceptor drum 15 and the transfer device 13, and the toner image is transferred on this recording paper.

Further, a fixing device 21 is arranged above the transfer device 13 of the printing unit 2, and the recording paper on which the toner image has been transferred is conveyed to the fixing device 21. The fixing device 21 heats and pressurizes the recording paper, fixes the toner image on the recording paper, and discharges the recording paper.

Subsequently, the recording paper is conveyed from the fixing device 21 to a relay conveyance device 8. In the relay conveyance device 8, the recording paper is introduced through a paper ejection roller 23, and by switching a switching gate 24, the recording paper is relayed and conveyed to the post-processing device 5 or is discharged to a discharge tray 25.

In the post-processing device 5, when the recording paper is introduced through a feed-in roller 26, by switching a switching gate 27, the recording paper is discharged without being post-processed to an upper deck paper ejection tray 28 or the recording paper is discharged to a lower deck paper ejection tray 29 after being post-processed.

The double-sided conveyance device 7 turns over the recording paper from a front surface to a back surface thereof when recording the toner image on both surfaces of the recording paper. Here, the toner image is recorded on the front surface of the recording paper, and when the recording paper is conveyed to the paper ejection roller 23, in the middle of conveyance of the recording paper by the paper ejection roller 23, the paper ejection roller 23 temporarily stops. The paper ejection roller 23 is reversely rotated, and the recording paper is guided to the double-sided conveyance device 7 by switching a gate 22. The recording paper is guided again to the printing unit 2 through the double-sided conveyance device 7, and the recording paper is turned over from the front surface to the back surface. The toner image is recorded on the back surface of the recording paper by the printing unit 2, and the recording paper is conveyed to the relay conveyance device 8 through the paper ejection roller 23.

On the other hand, reading of an original by the image reading device 3 is performed either in an automatic reading mode or a manual reading mode. In the automatic reading mode, the original is drawn out from an original set tray 36 by the original conveyance device 4. It is conveyed on an original placement table 35 and is discharged to an original discharge tray 37. In the image reading device 3, a first scanning unit 31 and a second scanning unit 32 are each positioned to a specified position. The original conveyed on the original placement table 35 is exposed by a light source of the first scanning unit 31, and by a mirror of each of the first scanning unit 31 and the second scanning unit 32, reflection light from the original is guided to a photoelectric conversion element 34 through an image forming lens 33. An image on the original is read by the photoelectric conversion element 34, and image data representing the image on the original is output.

In the manual reading mode, the original conveyance device 4 is rotary moved upward centering on a spindle on an end portion on a rear side of the original conveyance device 4. The original placement table 35 is opened, and the original is placed on the original placement table 35. In the image reading device 3, while alternately moving the first scanning unit 31 and the second scanning unit 32 at a predetermined speed relationship, the original on the original placement table 35 is exposed by the first scanning unit 31 and the second scanning unit 32. The reflection light from the original is guided to the photoelectric conversion element 34 through the image forming lens 33. The image on the original is read by the photoelectric conversion element 34, and the image data representing the image on the original is output.

The image data, after being image processed, is given to the optical scanning device 18 of the printing unit 2, and an electrostatic latent image corresponding to the image data is written on the surface of the photoreceptor drum 15 by the optical scanning device 18. Then, as described above, the electrostatic latent image on the surface of the photoreceptor drum 15 is developed. The toner image is transferred from the surface of the photoreceptor drum 15 to the recording paper, and the toner image on the recording paper is fixed.

In the printing unit 2 of the image forming device 1, the electrostatic latent image on the surface of the photoreceptor drum 15 is developed by the developing device 12 and becomes the toner image. After the toner image has been transferred from the surface of the photoreceptor drum 15 to the recording paper by the transfer device 13, the toner remaining on the surface of the photoreceptor drum 15 is removed by the cleaning device 14. Then, the removed toner is conveyed to a waste toner bottle as a waste toner and is recovered.

The developer conveyance device of the first preferred embodiment performs conveyance of the waste toner from the cleaning device 14 to the waste toner bottle. Next, the developer conveyance device of the first preferred embodiment is described in detail.

Figure 2:
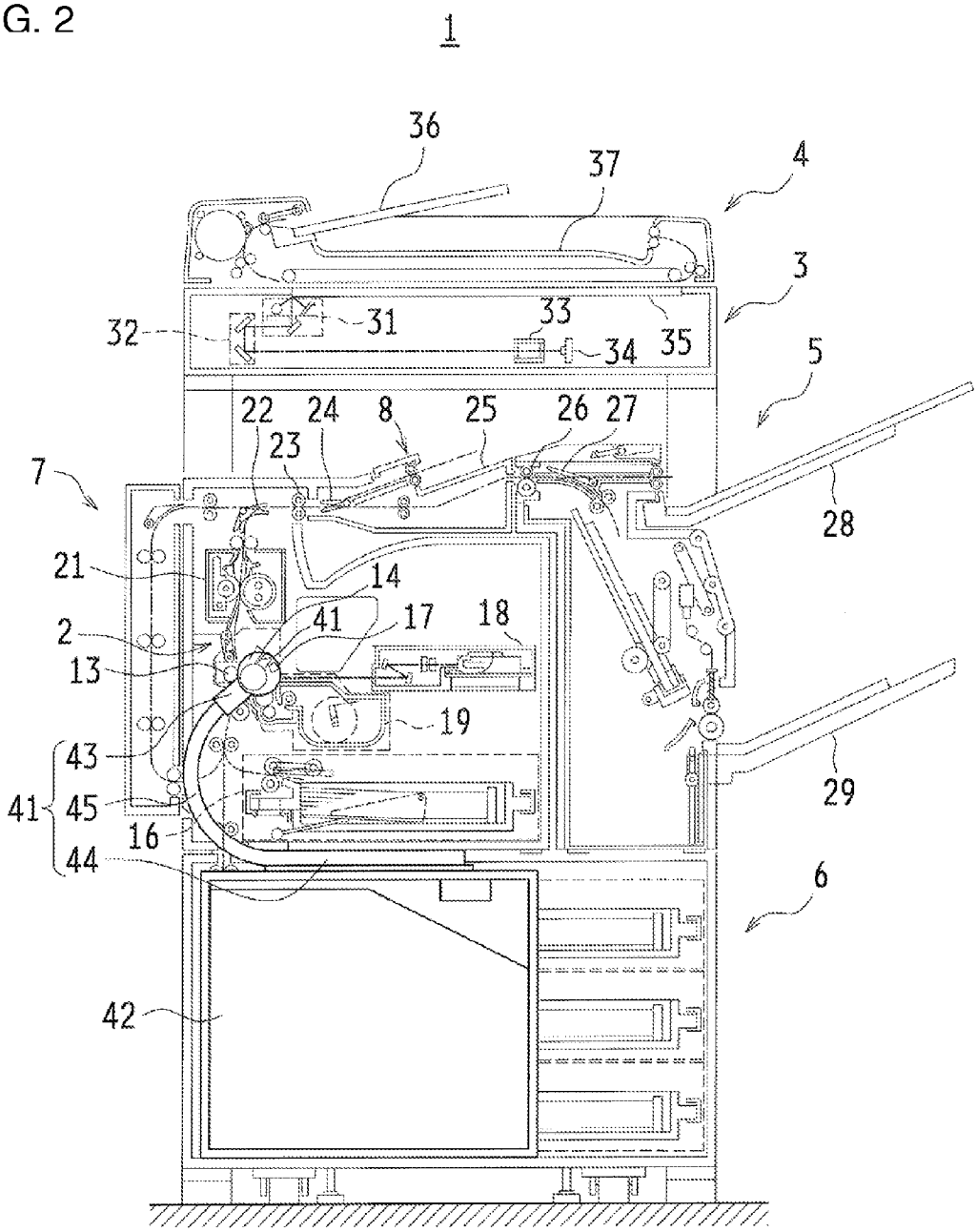
FIG. 2 is a view schematically illustrating the developer conveyance device of the first preferred embodiment of the present invention and a waste toner bottle arranged in the image forming device of FIG. 1 viewed from a rear side of the image forming device.

FIG. 2 is a view schematically illustrating a developer conveyance device 41 and a waste toner bottle 42 of the first preferred embodiment arranged in the image forming device 1 viewed from a rear side of the image forming device 1. Note, however, that in FIG. 2, a portion or element providing the same function as a portion or element in FIG. 1 is denoted with the same reference numeral. FIG. 1 is a view in which the developer conveyance device 41 and the waste toner bottle 42 are omitted.

As illustrated in FIG. 2, the waste toner bottle 42 is detachably arranged and is placed on a bottom of the paper supply device 6. The developer conveyance device 41 is provided with a waste toner receiving unit 43 detachably installed to the cartridge 19, a waste toner recovery unit 44 placed on a shelf 1*a* inside the image forming device 1 and arranged to an upper portion of the waste toner bottle 42, a conveyance hose 45 connecting the waste toner receiving unit 43 to the waste toner recovery unit 44, and the like. The developer conveyance device 41 receives the waste toner from the cleaning device 14 in the cartridge 19 to the waste toner receiving unit 43, conveys the waste toner from the waste toner receiving unit 43 to the waste toner recovery unit 44 through the conveyance hose 45, and further discharges the waste toner from the waste toner recovery unit 44 to the waste toner bottle 42, such that the waste toner is housed and recovered in the waste toner bottle 42.

Figure 3:
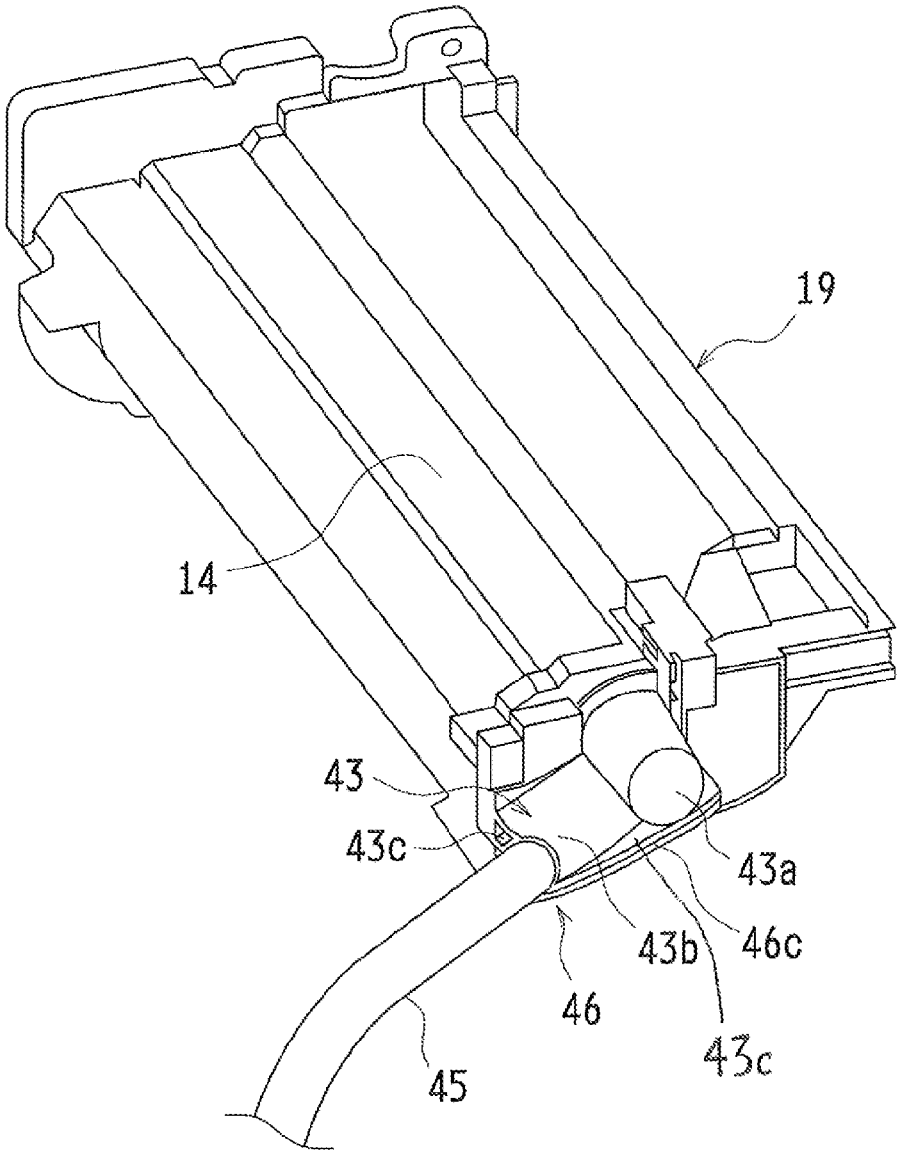
FIG. 3 is an enlarged perspective view illustrating a waste toner receiving unit, a conveyance hose, and the like in the developer conveyance device of the first preferred embodiment of the present invention.
Figure 4:
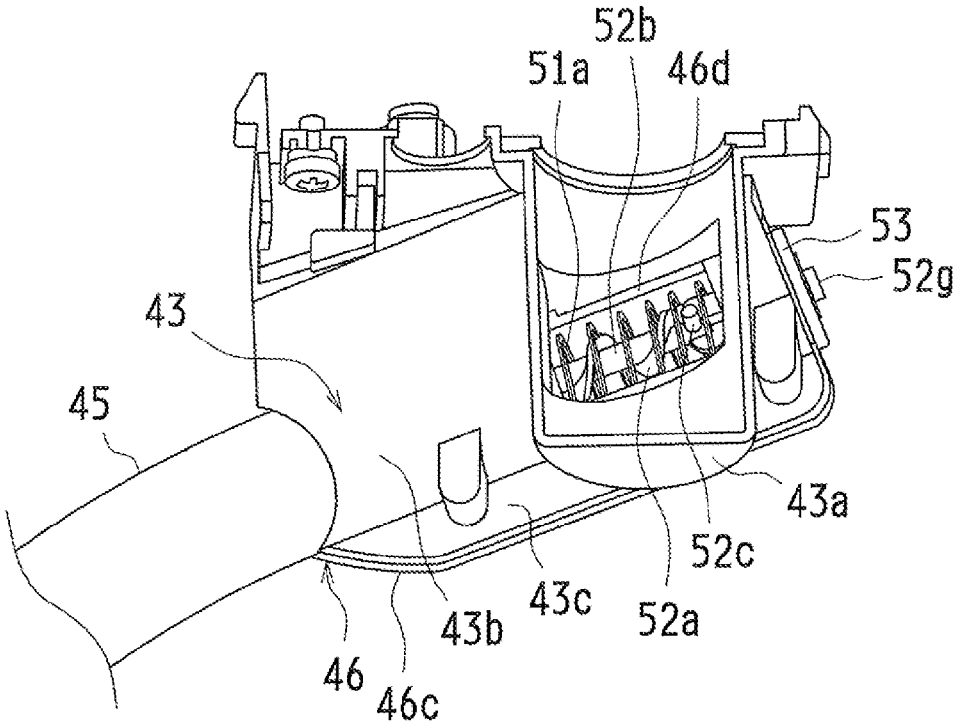
FIG. 4 is a perspective view illustrating the partially broken waste toner receiving unit.
Figure 5:
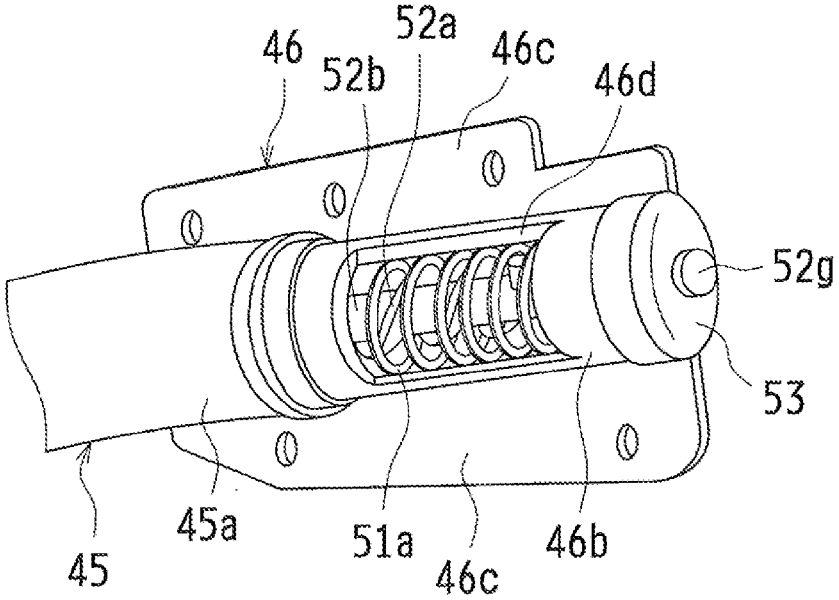
FIG. 5 is a perspective view illustrating a joint unit of the waste toner receiving unit.
Figure 6:
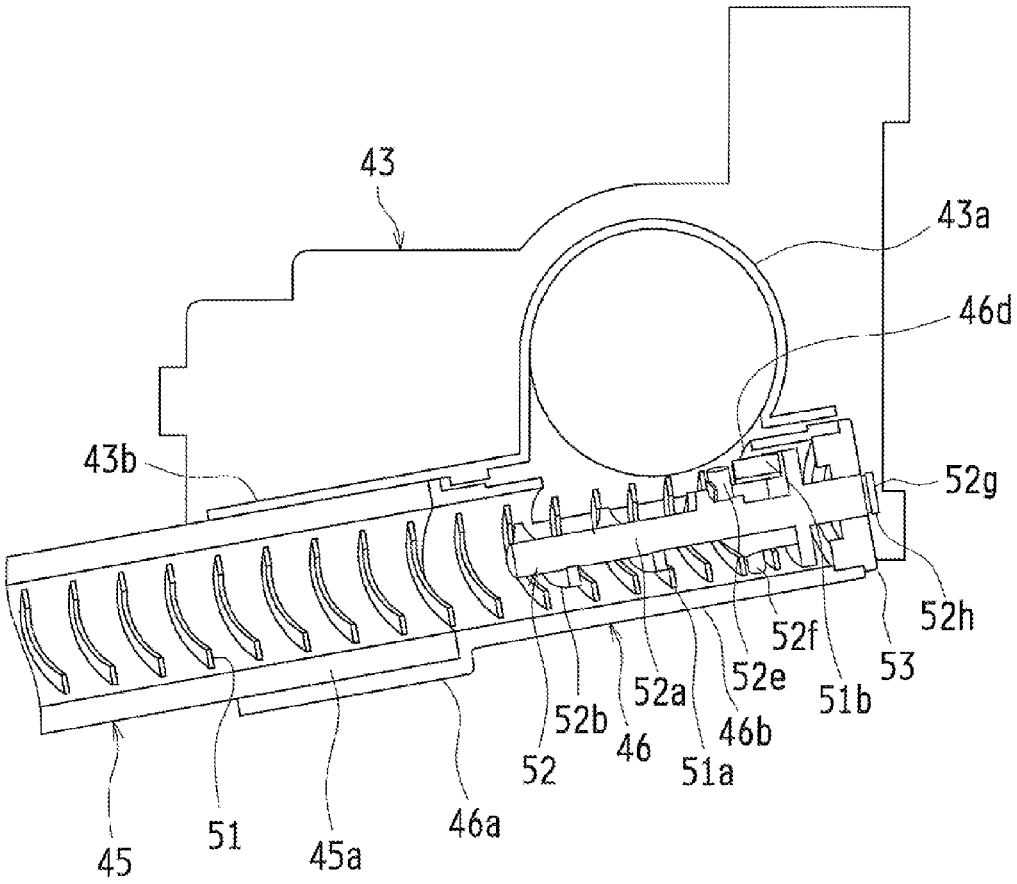

FIG. 3 is an enlarged perspective view illustrating the cartridge 19, the waste toner receiving unit 43, and the conveyance hose 45. FIG. 4 is a perspective view illustrating the partially broken waste toner receiving unit 43, and FIG. 5 is a perspective view illustrating a joint unit 46 of the waste toner receiving unit 43. Further, FIG. 6 is a perspective view illustrating the partially broken waste toner receiving unit 43, the conveyance hose 45, and the like.

As illustrated in FIGS. 3 to 6, the waste toner receiving unit 43 preferably includes a main body includes a cylindrical cover 43*a*, a semi-cylindrical portion 43*b*, and each of flat plate portions 43*c* provided on both sides of the semi-cylindrical portion 43*b*; and the joint unit 46 including a substantially lower portion of the waste toner receiving unit 43. The main body preferably is a molded article of synthetic resin having sufficient rigidity. The waste toner receiving unit 43 is detachably installed to the cartridge 19, and the cylindrical cover 43*a* is connected to the cleaning device 14 of the cartridge 19. In the cleaning device 14, for example, a blade (not illustrated) is slidingly contacted to the surface of the photoreceptor drum 15, and the toner remaining on the surface of the photoreceptor drum 15 is scraped off by the blade. The waste toner that has been scraped off is conveyed by a screw extending in a shaft direction of the photoreceptor drum 15 to inside of the cylindrical cover 43*a* of the waste toner receiving unit 43 and is discharged. Thus, the waste toner that has been removed and conveyed from the surface of the photoreceptor drum 15 by the cleaning device 14 is discharged to the inside of the cylindrical cover 43*a* of the waste toner receiving unit 43.

A lower half of the semi-cylindrical portion 43*b* of the waste toner receiving unit 43 is opened, and the joint unit 46 is installed below the semi-cylindrical portion 43*b*. This joint unit 46 includes a semi-cylindrical portion 46*a*, a cylindrical portion 46*b* continuously formed with the semi-cylindrical portion 46*a*, and each of flat plate portions 46*c* provided on both sides of the semi-cylindrical portion 46*a* and the cylindrical portion 46*b*. An upper half of the semi-cylindrical portion 46*a* is opened.

Here, one end 45*a* of the conveyance hose 45 is inserted inside the semi-cylindrical portion 46*a* of the joint unit 46, and each of the flat plate portions 46*c* of the joint unit 46 is overlapped with and fixed to each of the flat plate portions 43*c* on both sides of the semi-cylindrical portion 43*b*. Inside a cylinder including the semi-cylindrical portion 46*a* on a lower side and the semi-cylindrical portion 43*b* on an upper side, the one end 45*a* of the conveyance hose 45 is fitted and supported.

In this state, an opening 46*d* in an upper portion of the cylindrical portion 46*b* of the joint unit 46 is positioned below the cylindrical cover 43*a*. Accordingly, the waste toner discharged from the cleaning device 14 to the inside of the cylindrical cover 43*a* of the waste toner receiving unit 43 is naturally dropped to the opening 46*d* of the cylindrical portion 46*b* of the joint unit 46 inside the cylindrical cover 43*a*.

One spiral coil 51 is rotatably inserted inside the conveyance hose 45, and the spiral coil 51 extends from the waste toner receiving unit 43 to the waste toner recovery unit 44. The conveyance hose 45 is a tubular body preferably made of, for example, a flexible synthetic resin, and the spiral coil 51 is preferably made of, for example, a spirally molded metal thin belt. Thus, as illustrated in FIG. 2, any portion of the conveyance hose 45 and the spiral coil 51 is capable of being flexibly curved and disposed between the waste toner receiving unit 43 and the waste toner recovery unit 44.

A shaft member 52 is inserted inside one end portion 51*a* of the spiral coil 51, and the one end portion 51*a* of the spiral coil 51 is coupled and locked to the shaft member 52.

Figure 7A:
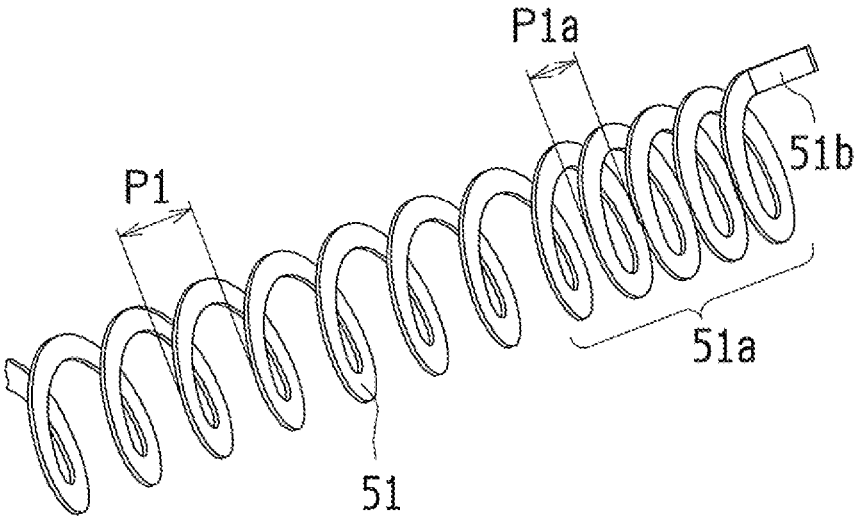
FIGS. 7A and 7B are perspective views each illustrating an area near one end portion of a spiral coil and a shaft member.
Figure 7B:
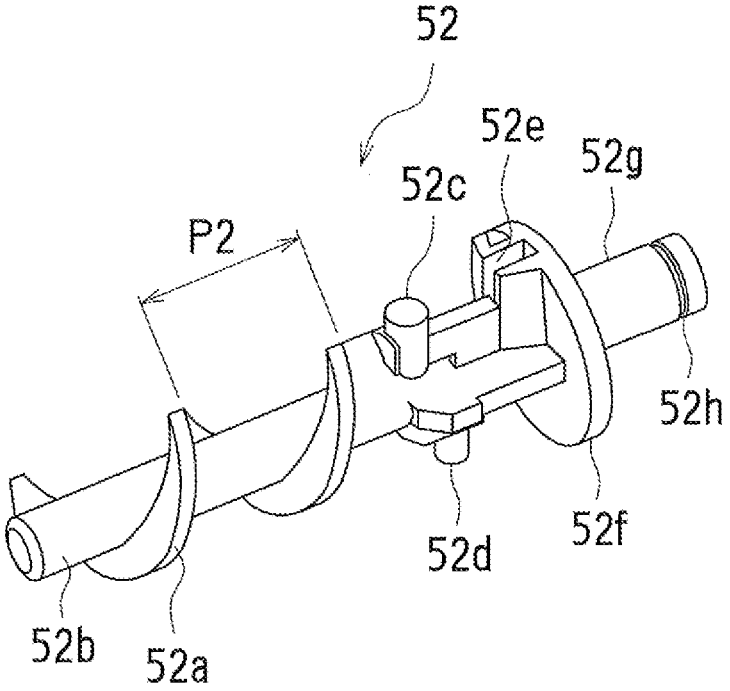

FIGS. 7A and 7B are perspective views each illustrating an area near one end portion of the spiral coil 51 and the shaft member 52. As illustrated in FIG. 7A, the spiral coil 51 preferably includes the spirally molded metal thin belt, and a pitch P1*a* at the one end portion 51*a* of the spiral coil 51 preferably is narrower than a pitch P1 near the center of the spiral coil 51. The pitch P1 is maintained to be constant entirely or substantially entirely excluding both end portions of the spiral coil 51. In the one end portion 51*a* of the spiral coil 51, an engagement portion 51*b* configured by bending an end piece of the spiral coil 51 at a right angle or a substantially right angle is provided.

As illustrated in FIG. 7B, the shaft member 52 preferably is made of a synthetic resin (for example, ABS) molded article having sufficient rigidity, and includes a cylindrical shaft 52*a*; a spiral screw 52*b* provided on an outer periphery of the cylindrical shaft 52*a*; two projections 52*c* and 52*d* each installed in a protruding manner on the outer periphery of the cylindrical shaft 52*a* in an opposite direction from each other at a half distance of the pitch P1*a*; a fitting recess 52*e* provided separately from the projection 52*d*; a round plate 52*f*; and an shaft end portion 52*g*. A direction of a spiral of the spiral screw 52*b* of the shaft member 52 is the same as a direction of a spiral of the spiral coil 51. A pitch P2 of the spiral screw 52*b* preferably is set to be sufficiently longer than the pitch P1*a* of the one end portion 51*a* of the spiral coil 51. Further, the spiral screw 52*b* is extended to an area near the conveyance hose 45 relative to the opening 46*d* of the cylindrical portion 46*b* (toner conveyance direction) and is outside of an area of the opening 46*d*.

As illustrated in FIGS. 4 and 6, the shaft member 52 is inserted into the one end portion 51*a* of the spiral coil 51. The spiral coil 51 passes through each of the projections 52*c* and 52*d* of the shaft member 52, and the engagement portion 51*b* of the spiral coil 51 is fitted into the fitting recess 52*e* of the shaft member 52. Thus, the one end portion 51*a* of the spiral coil 51 is coupled and locked to the shaft member 52, and the spiral screw 52*b* of the shaft member 52 is arranged inside of the one end portion 51*a* of the spiral coil 51.

A bearing portion 53 is fitted to an end portion of the cylindrical portion 46*b* of the joint unit 46. The shaft end portion 52*g* of the shaft member 52 is inserted into a hole in the middle of the bearing portion 53, and outside of the bearing portion 53, a retaining snap ring (not illustrated) is fitted to a groove 52*h* of the shaft end portion 52*g*. Thus, the shaft member 52 is pivotally supported, and the one end portion 51*a* of the spiral coil 51 is rotatably supported.

In this way, the one end portion 51*a* of the spiral coil 51 is coupled and locked to the shaft member 52, such that the spiral coil 51 and the shaft member 52 are integrally rotated inside the conveyance hose 45 and the cylindrical portion 46*b* of the joint unit 46.

Figure 8:
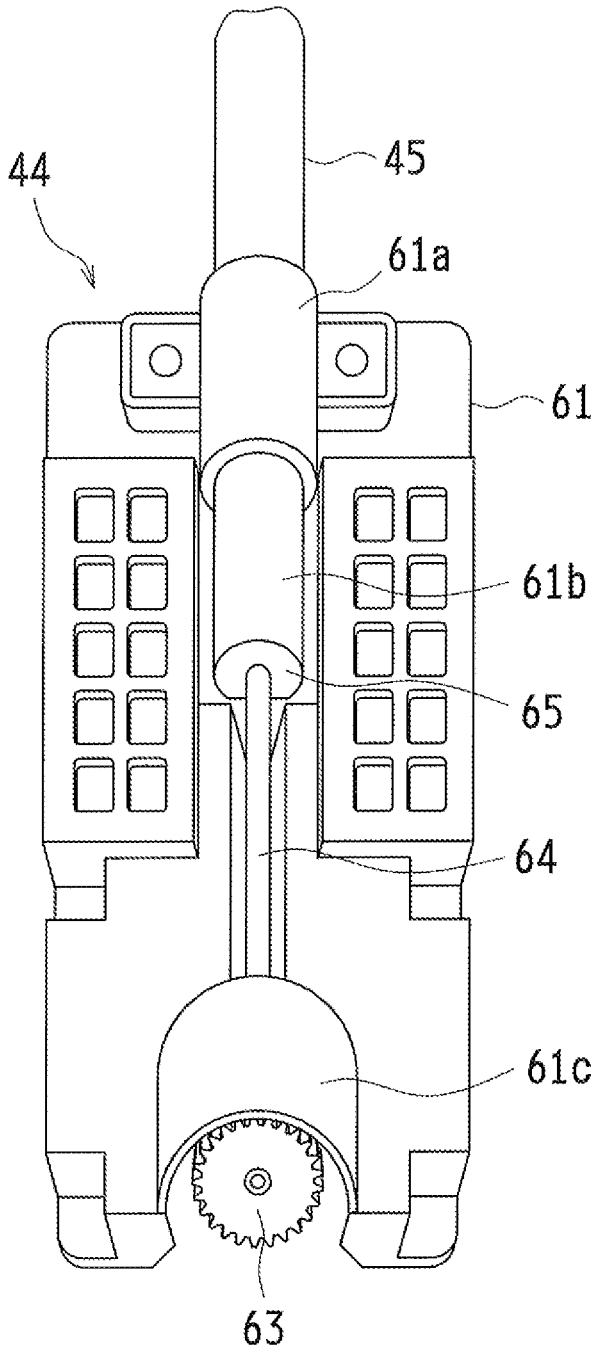
FIG. 8 is a perspective view illustrating a waste toner recovery unit and the conveyance hose in the developer conveyance device of the first preferred embodiment of the present invention.
Figure 9:
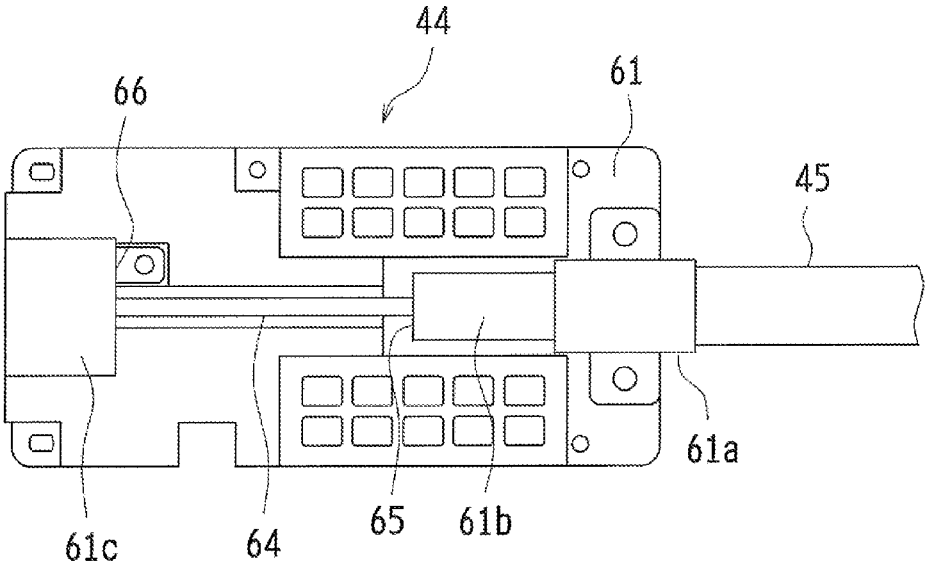
FIG. 9 is a planar view illustrating the waste toner recovery unit.
Figure 10:
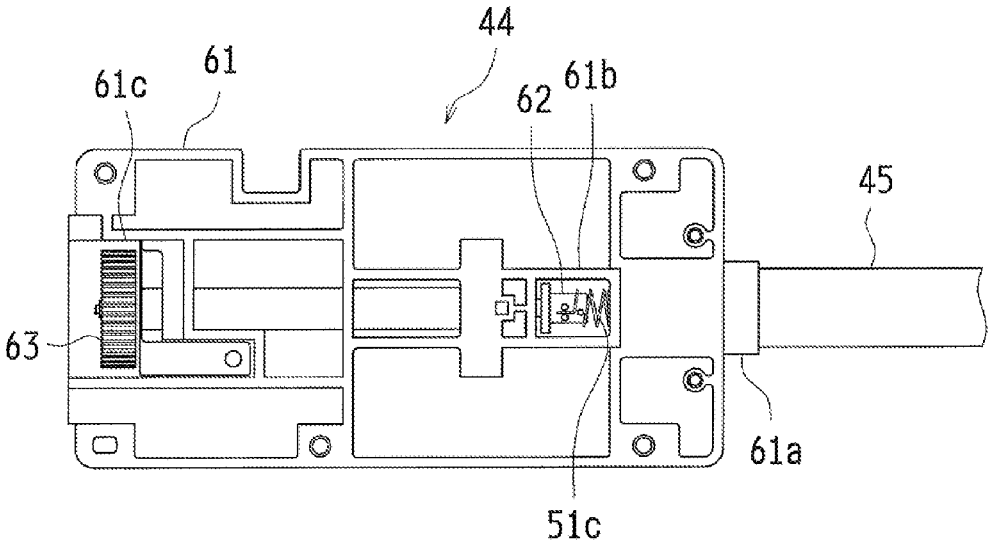
FIG. 10 is an underside view illustrating the waste toner recovery unit.
Figure 11:
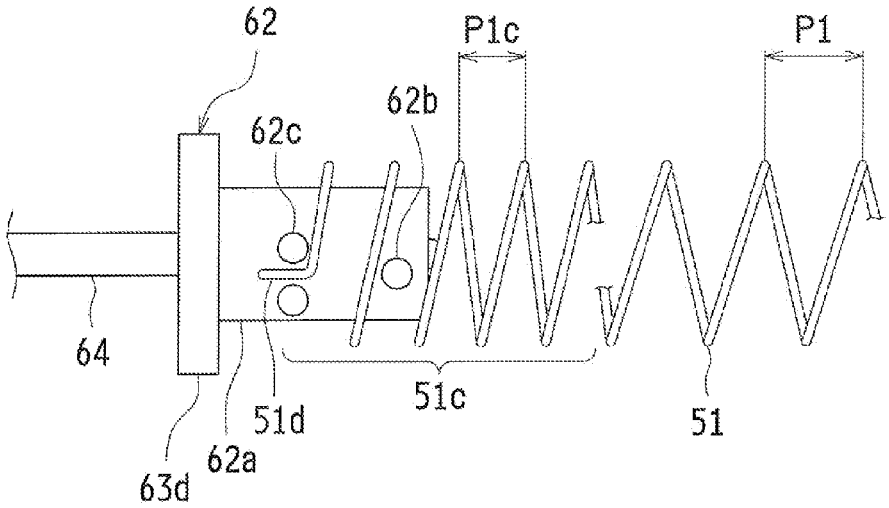
FIG. 11 is a side view illustrating an area around the other end portion of the spiral coil.

On the other hand, the waste toner recovery unit 44 is configured as follows. FIG. 8 is a perspective view illustrating the waste toner recovery unit 44 and the conveyance hose 45. FIGS. 9 and 10 are a planar view and an underside view illustrating the waste toner recovery unit 44. Further, FIG. 11 is a side view illustrating around another end portion 51*c* of the spiral coil 51.

As illustrated in FIGS. 8 to 11, the waste toner recovery unit 44 preferably includes a rectangular or substantially rectangular main plate 61; a joint unit 62 coupled and locked to the other end portion 51*c* of the spiral coil 51 on one end side of the main plate 61; a drive gear 63 provided on the one end side of the main plate 61; a drive shaft 64 connecting the joint unit 62 to the drive gear 63; and the like.

The main plate 61 preferably is a synthetic resin molded article having sufficient rigidity, and includes a medium cylindrical portion 61*a* provided on the one end side of the main plate 61; a small cylindrical portion 61*b* provided adjacent to the medium cylindrical portion 61*a*; and a large semi-cylindrical portion 61*c* provided on the other end side of the main plate 61. A lower side of the small cylindrical portion 61*b* and a lower half of the large semi-cylindrical portion 61*c* are open.

Another end portion of the conveyance hose 45 is engaged and fixed to the medium cylindrical portion 61*a*. The other end portion 51*c* of the spiral coil 51 projects from the other end portion of the conveyance hose 45, reaches inside the small cylindrical portion 61*b*, and is coupled and locked to the joint unit 62 inside the small cylindrical portion 61*b*. A pitch P1*c* at the other end portion 51*c* of the spiral coil 51 preferably is set to be narrower than the pitch P1 near the center of the spiral coil 51. In the other end portion 51*c* of the spiral coil 51, an engagement portion 51*d* configured by bending an end piece of the spiral coil 51 at a right angle or a substantially right angle is provided.

The joint unit 62 is a synthetic resin (for example, ABS) molded article having sufficient rigidity, and includes a cylindrical shaft 62*a*; two projections 62*b* (one of the projections is not illustrated) each installed in a protruding manner on an outer periphery of the cylindrical shaft 62*a* in an opposite direction from each other at a half distance of the pitch P1*a*; a fitting recess 62*c*; and a round plate 63*d*.

The joint unit 62 is inserted inside the other end portion 51*c* of the spiral coil 51. The spiral coil 51 passes through each of the projections 62*b* of the joint unit 62, and the engagement portion 51*d* of the spiral coil 51 is fitted into the fitting recess 62*c* of the joint unit 62. Thus, the other end portion 51*c* of the spiral coil 51 is coupled and locked to the joint unit 62.

The drive shaft 64 preferably is a metal shaft and is pivotally supported by being passed through a hole of a bearing portion 65, which is fitted to an inward opening end of the small cylindrical portion 61*b*, and a hole of a bearing portion 66, which is fitted to an inward opening end of the large semi-cylindrical portion 61*c*. One end of the drive shaft 64 is connected and fixed to the joint unit 62 inside the small cylindrical portion 61*b*, and the other end of the drive shaft 64 is connected and fixed to the drive gear 63 inside the large semi-cylindrical portion 61*c*.

As described above, the waste toner recovery unit 44 is placed on the shelf la (illustrated in FIG. 2) inside the image forming device 1. On the shelf 1*a*, there is provided a drive motor unit (not illustrated), which rotary drives the drive gear 63, and the drive gear 63 is rotary driven by this drive motor unit.

In the developer conveyance device 41 having this configuration, when the drive gear 63 of the waste toner recovery unit 44 is rotary driven, the drive shaft 64 and the joint unit 62 are rotated. The other end portion 51*c* of the spiral coil 51, which is coupled and locked to the joint unit 62, is rotated, and the entire spiral coil 51 is rotated inside the conveyance hose 45. Then, in the waste toner receiving unit 43, the one end portion 51*a* of the spiral coil 51 is rotated, and the shaft member 52, which is coupled and locked to the one end portion 51*a*, is rotated, such that the spiral screw 52*b* of the shaft member 52 is also rotated.

Since the direction of the spiral of the spiral coil 51 and the direction of the spiral of the spiral screw 52*b* of the shaft member 52 are the same, by setting a direction of rotation of the spiral coil 51 and that of the spiral screw 52*b* as appropriate, it is possible to set a direction of conveyance of the waste toner by the spiral coil 51 and that by the spiral screw 52*b* to a direction from the waste toner receiving unit 43 to the waste toner recovery unit 44.

In this state, when the waste toner that has been removed and conveyed from the surface of the photoreceptor drum 15 by the cleaning device 14 is conveyed and discharged to the inside of the cylindrical cover 43*a* of the waste toner receiving unit 43, the waste toner is naturally dropped to the opening 46*d* of the cylindrical portion 46*b*. Thus, the waste toner drops on the one end portion 51*a* of the spiral coil 51 and the spiral screw 52*b* inside the cylindrical portion 46*b* through the opening 46*d*. Then, the spiral coil 51 and the spiral screw 52*b* rotate in the same direction and send the waste toner from the cylindrical portion 46*b* to the conveyance hose 45. Further, the waste toner is conveyed to the waste toner recovery unit 44 by the spiral coil 51 inside the conveyance hose 45. When it reaches the small cylindrical portion 61*b* of the waste toner recovery unit 44, since the lower side of the small cylindrical portion 61*b* is opened, it is dropped and discharged from the small cylindrical portion 61*b* to the waste toner bottle 42, and is housed and recovered in the waste toner bottle 42.

Here, since a moving space of the waste toner is limited inside the conveyance hose 45, it is possible to efficiently convey the waste toner by using the spiral coil 51. In contrast, at the opening 46*d* of the cylindrical portion 46*b*, since an upper side of the spiral coil 51 is opened, the waste toner is easily moved in a vertical direction, such that a conveyance efficiency of the waste toner is decreased when only the spiral coil 51 is used.

In the developer conveyance device 41 of the first preferred embodiment, however, the spiral screw 52*b* is arranged inside the one end portion 51*a* of the spiral coil 51, and the spiral coil 51 and the spiral screw 52*b* are both rotated, accompanied by rotation of the spiral coil 51, even if the waste toner tries to pass through the one end portion 51*a* of the spiral coil 51 and move in the vertical direction, movement of the waste toner in the vertical direction is blocked by the spiral screw 52*b*, such that the waste toner is conveyed by the spiral screw 52*b*. Since the waste toner hardly passes through the spiral coil 51 in the vertical direction, the waste toner is also conveyed by the one end portion 51*a* of the spiral coil 51. That is, the waste toner is surely conveyed by the spiral screw 52*b* and the one end portion 51*a* of the spiral coil 51.

Since the spiral screw 52*b* is extended to an area near the conveyance hose 45 relative to the opening 46*d* of the cylindrical portion 46*b* (toner conveyance direction), the waste toner is surely conveyed from the opening 46*d* to the inside of the conveyance hose 45.

In a situation where solidification of the waste toner is progressing, even if the spiral coil 51 is elastically deformed by being buried in the waste toner, the spiral screw 52*b* is not elastically deformed, such that a conveyance performance of the waste toner of the spiral screw 52*b* is maintained, and the solidification of the waste toner is effectively prevented.

Further, since the spiral coil 51 and the spiral screw 52*b* are integrally rotated, and the pitch P2 of the spiral screw 52*b* preferably is set to be sufficiently longer than the pitch P1*a* of the one end portion 51*a* of the spiral coil 51, a conveyance speed of the waste toner by the spiral screw 52*b* becomes faster than a conveyance speed of the waste toner by the one end portion 51*a* of the spiral coil 51, such that at the opening 46*d* of the cylindrical portion 46*b*, the waste toner is more surely conveyed by the spiral screw 52*b*. Due to a difference between the conveyance speed by the spiral screw 52*b* and the conveyance speed by the one end portion 51*a* of the spiral coil 51, the solidification of the waste toner is effectively prevented.

Second Preferred Embodiment

Figure 12:
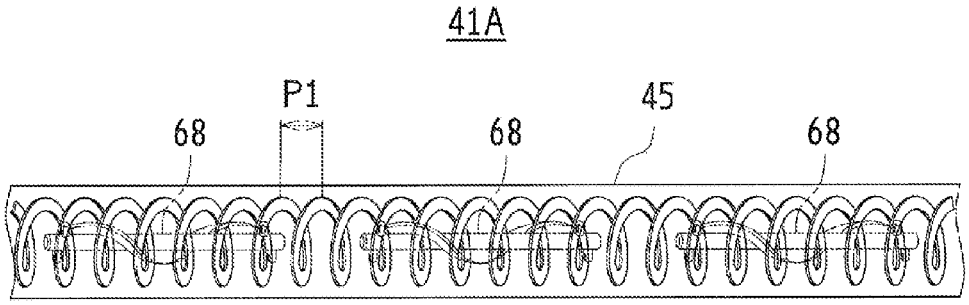
FIG. 12 is a sectional view schematically illustrating a developer conveyance device according to a second preferred embodiment of the present invention.

FIG. 12 is a sectional view schematically illustrating a developer conveyance device of a second preferred embodiment of the present invention. As illustrated in FIG. 12, in a developer conveyance device 41A of the second preferred embodiment, one spiral coil 51 is rotatably inserted inside the conveyance hose 45. A plurality of screw members 68 is inserted inside the spiral coil 51, and each of the screw members 68 is fixed to a plurality of places of the spiral coil 51 in a lengthwise direction.

Figure 13:
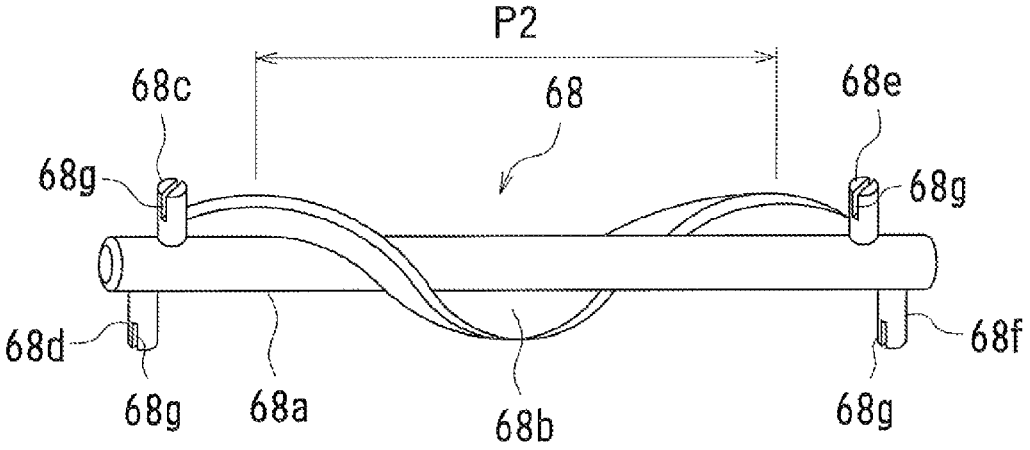
FIG. 13 is a perspective view illustrating a screw member in the developer conveyance device of the second preferred embodiment of the present invention.

FIG. 13 is a perspective view illustrating the screw member 68. As illustrated in FIG. 13, the screw member 68 is a synthetic resin (for example, ABS) molded article having sufficient rigidity, and includes a cylindrical shaft 68*a*; a spiral screw 68*b* on an outer periphery of the cylindrical shaft 68*a*; two projections 68*c* and 68*d* each installed in a protruding manner on an outer periphery of one end portion of the cylindrical shaft 68*a* in an opposite direction from each other at a half distance of the pitch P1 of the spiral coil 51; and two projections 68*e* and 68*f* each installed in a protruding manner on an outer periphery of the other end of the cylindrical shaft 68*a* in an opposite direction from each other at a half distance of the pitch P1. A direction of a spiral of the spiral screw 68*b* of the screw member 68 is the same as a direction of a spiral of the spiral coil 51. The pitch P2 of the spiral screw 68*b* preferably is set to be sufficiently longer than the pitch P1 of the spiral coil 51.

The screw member 68 is arranged so as to be inserted inside the spiral coil 51. The spiral coil 51 is inserted into a slit 68*g* of each of the projections 68*c* and 68*d* on an outer periphery of the one end portion of the cylindrical shaft 68*a*, and the spiral coil 51 is adhered to each of the projections 68*c* and 68*d*. Similarly, the spiral coil 51 is inserted into the slit 68*g* of each of the projections 68*e* and 68*f* on an outer periphery of the other end portion of the cylindrical shaft 68*a*, and the spiral coil 51 is adhered to each of the projections 68*e* and 68*f*. Thus, the screw member 68 is fixed to inside of the spiral coil 51.

In this developer conveyance device 41*a* of the second preferred embodiment, when the spiral coil 51 is rotated, each of the screw members 68 is also rotated, such that waste toner inside the conveyance hose 45 is promptly conveyed in one direction by the spiral coil 51 and the spiral screw 68*b* of each of the screw members 68.

In a situation where solidification of the waste toner is progressing, even if the spiral coil 51 is elastically deformed by being buried in the waste toner, the spiral screw 68*b* is not elastically deformed, such that a conveyance performance of the waste toner by the spiral screw 68*b* is maintained, and the solidification of the waste toner is effectively prevented.

Further, since a pitch P2 of the spiral screw 68*b* preferably is set to be sufficiently longer than the pitch P1 of the spiral coil 51, a conveyance speed of the waste toner by the spiral screw 68*b* becomes faster than a conveyance speed of the waste toner by the spiral coil 51. Due to a difference between the conveyance speed by the spiral screw 68*b* and the conveyance speed by the spiral coil 51, the solidification of the waste toner can be more effectively prevented.

Third Preferred Embodiment

Figure 14:
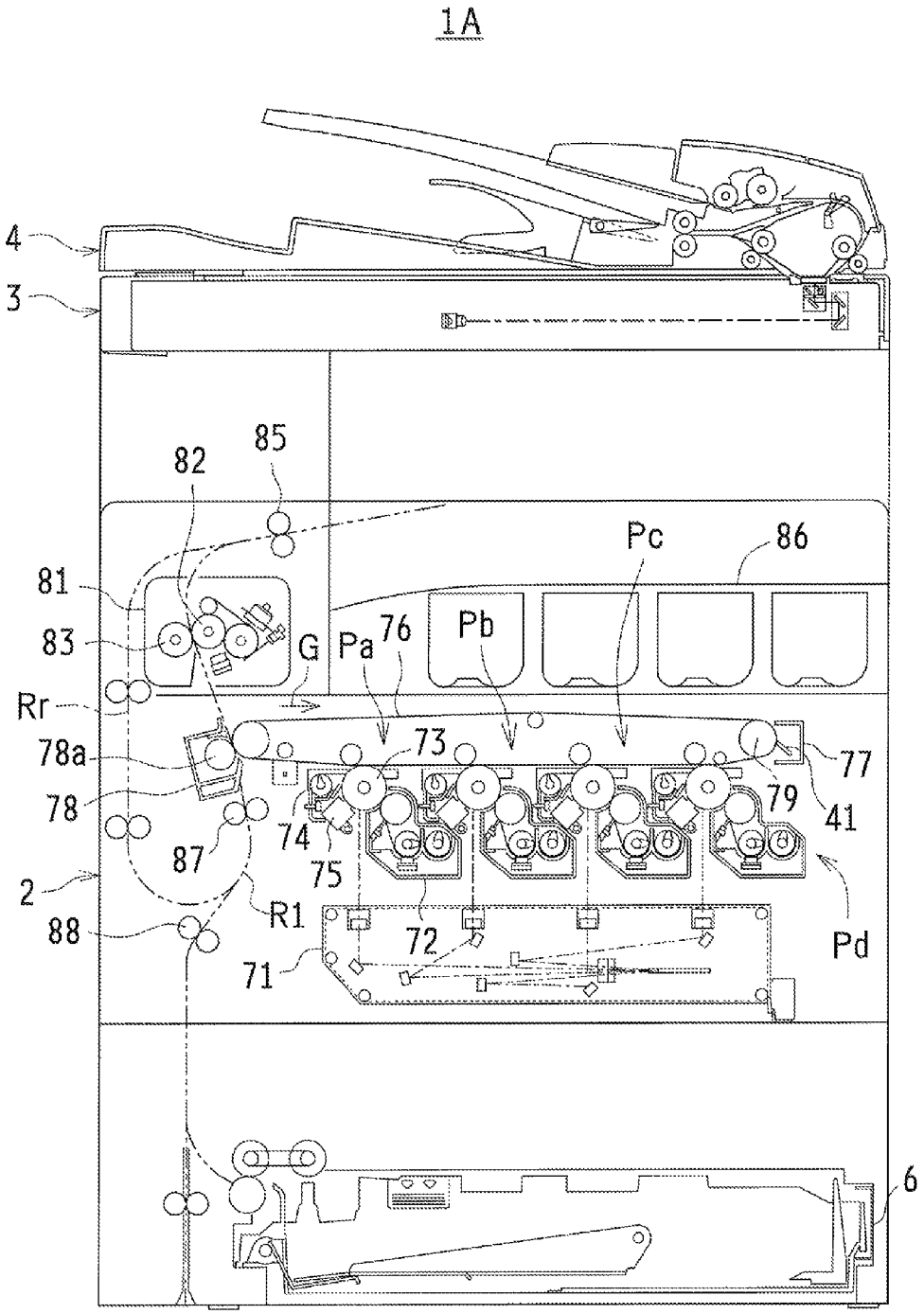
FIG. 14 is a sectional view illustrating an image forming device, to which a developer conveyance device of a third preferred embodiment of the present invention is applied, viewed from the front side.

FIG. 14 is a sectional view illustrating an image forming device, to which a developer conveyance device of a third preferred embodiment of the present invention is applied, viewed from a front side. An image forming device 1A is provided with the printing unit 2, the image reading device 3, the original conveyance device 4, the paper supply device 6, and the like.

Image data handled in the image forming device 1A is image data corresponding to a color image using each of colors of black (K), cyan(C), magenta (M), and yellow (Y) or image data corresponding to a monochrome image using a single color (for example, black). Accordingly, in the printing unit 2, in order to form toner images of four types corresponding to each of the colors, there are preferably provided four developing devices 72, four photoreceptor drums 73, four drum cleaning devices 74, and four charging devices 75, such that four image stations Pa, Pb, Pc, and Pd, which are respectively associated with black, cyan, magenta, and yellow, are configured.

In any of the image stations Pa, Pb, Pc, and Pd, after toner remaining on a surface of the photoreceptor drum 73 is removed by the drum cleaning device 74, the surface of the photoreceptor drum 73 is uniformly charged with a predetermined electric potential by the charging device 75. The surface of the photoreceptor drum 73 is exposed by an optical scanning device 71 to form an electrostatic latent image on the surface thereof, and the electrostatic latent image on the surface of the photoreceptor drum 73 is developed by the developing device 72, such that the toner image is formed on the surface of the photoreceptor drum 73. Thus, the toner image of each of the colors is formed on the surface of each of the photoreceptor drums 73.

Subsequently, after the toner remaining on a surface of an intermediate transfer belt 76 is removed by a belt cleaning device 77 while an intermediate transfer belt 76 is circularly moved in an arrow direction G, the toner image of each of the colors on the surface of each of the photoreceptor drums 73 is transferred and overlapped on the intermediate transfer belt 76 one by one, such that a color toner image is formed on the intermediate transfer belt 76.

A nip zone is provided between the intermediate transfer belt 76 and a secondary transfer roller 78*a* of a secondary transfer device 78, and while conveying recording paper, which has been conveyed through a paper conveyance path R1, by sandwiching it in the nip zone, the color toner image on a surface of the intermediate transfer belt 76 is transferred on the recording paper. Then, the recording paper is heated and pressurized being sandwiched between a heating roller 82 of a fixing device 81 and a pressurizing roller 83, such that the color toner image on the recording paper is fixed.

From the paper supply device 6, the recording paper is drawn out and is supplied one sheet by one sheet. The recording paper is conveyed through the paper conveyance path R1, is passed through the secondary transfer device 78 and the fixing device 81, and is carried out to a paper ejection tray 86 through a paper ejection roller 85. In this paper conveyance path R1, there are preferably arranged: a resist roller 87, which starts conveyance of the recording paper after temporarily stopping the recording paper and aligning a leading end of the recording paper according to transfer timing of the color toner image in the nip zone between the intermediate transfer belt 76 and the secondary transfer roller 78*a*; each of conveyance rollers 88, which prompts conveyance of the recording paper; a paper ejection roller 85; and the like.

Further, in a case where image formation is performed not only on a front surface of the recording paper but also on a back surface thereof, the recording paper is conveyed in an opposite direction from the paper ejection roller 85 to a turn over path Rr. The recording paper is turned over from the front surface to the back surface, and the recording paper is guided again to the resist roller 87. Similarly with the front surface of the recording paper, an image is recorded and fixed on the back surface of the recording paper, and the recording paper is discharged to the paper ejection tray 86.

Figure 15:
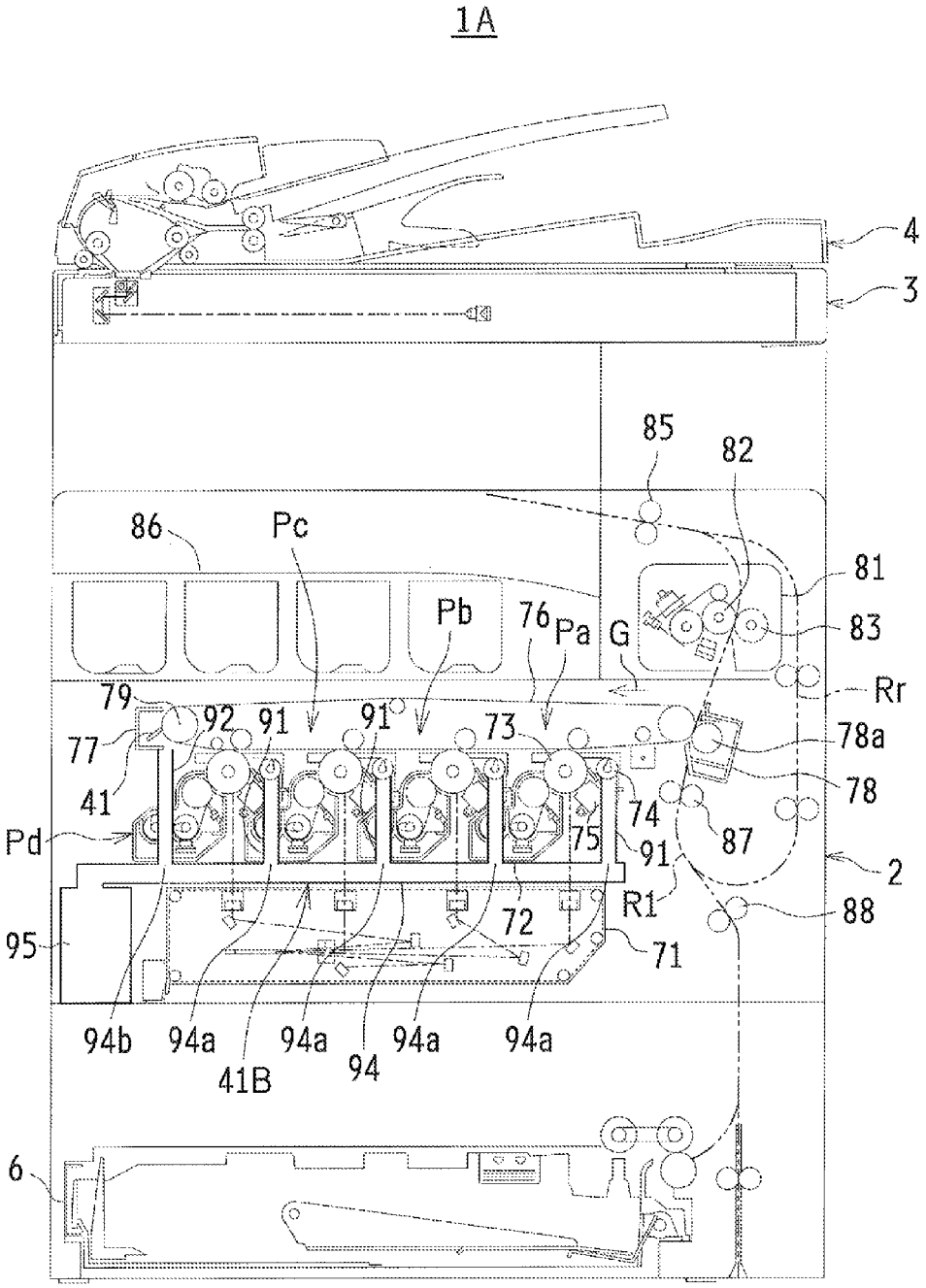
FIG. 15 is a rear side view schematically illustrating the developer conveyance device and the waste toner bottle of the third preferred embodiment of the present invention arranged in the image forming device of FIG. 14 viewed from a rear side of the image forming device.

FIG. 15 is a view schematically illustrating a developer conveyance device 41B and a waste toner bottle 95 of the third preferred embodiment arranged in the image forming device 1A viewed from a rear side of the image forming device 1A. Here, in any of the image stations Pa, Pb, Pc, and Pd, the drum cleaning device 74 removes the toner remaining on the surface of the photoreceptor drum 73. The removed waste toner is conveyed to a front side of the image forming device 1A by a screw extending in a shaft direction of the photoreceptor drum 73, and the waste toner is discharged to a vertically standing pipe 91. Thus, the toner remaining on the surface of the four photoreceptor drums 73 is removed by the four drum cleaning devices 74. The waste toner is conveyed to the front side of the image forming device 1A by each of the drum cleaning devices 74, and the waste toner is discharged to the four pipes 91.

Similarly, the belt cleaning device 77 removes the toner remaining on the surface of the intermediate transfer belt 76, and the removed waste toner is conveyed to the front side of the image forming device 1A by a screw extending in a width direction of the intermediate transfer belt 76, such that the waste toner is discharged to a vertically standing pipe 92.

Accordingly, the waste toner discharged to each of the pipes 91 and 92 is naturally dropped to each of the openings 94*a* and 94*b* of a conveyance hose 94 of the developer conveyance device 41*b* through each of the pipes 91 and 92. In the developer conveyance device 41*b*, the waste toner is conveyed to an upper side of the waste toner bottle 95 through the conveyance hose 94, and the waste toner is discharged to and recovered in the waste toner bottle 95.

Figure 16:
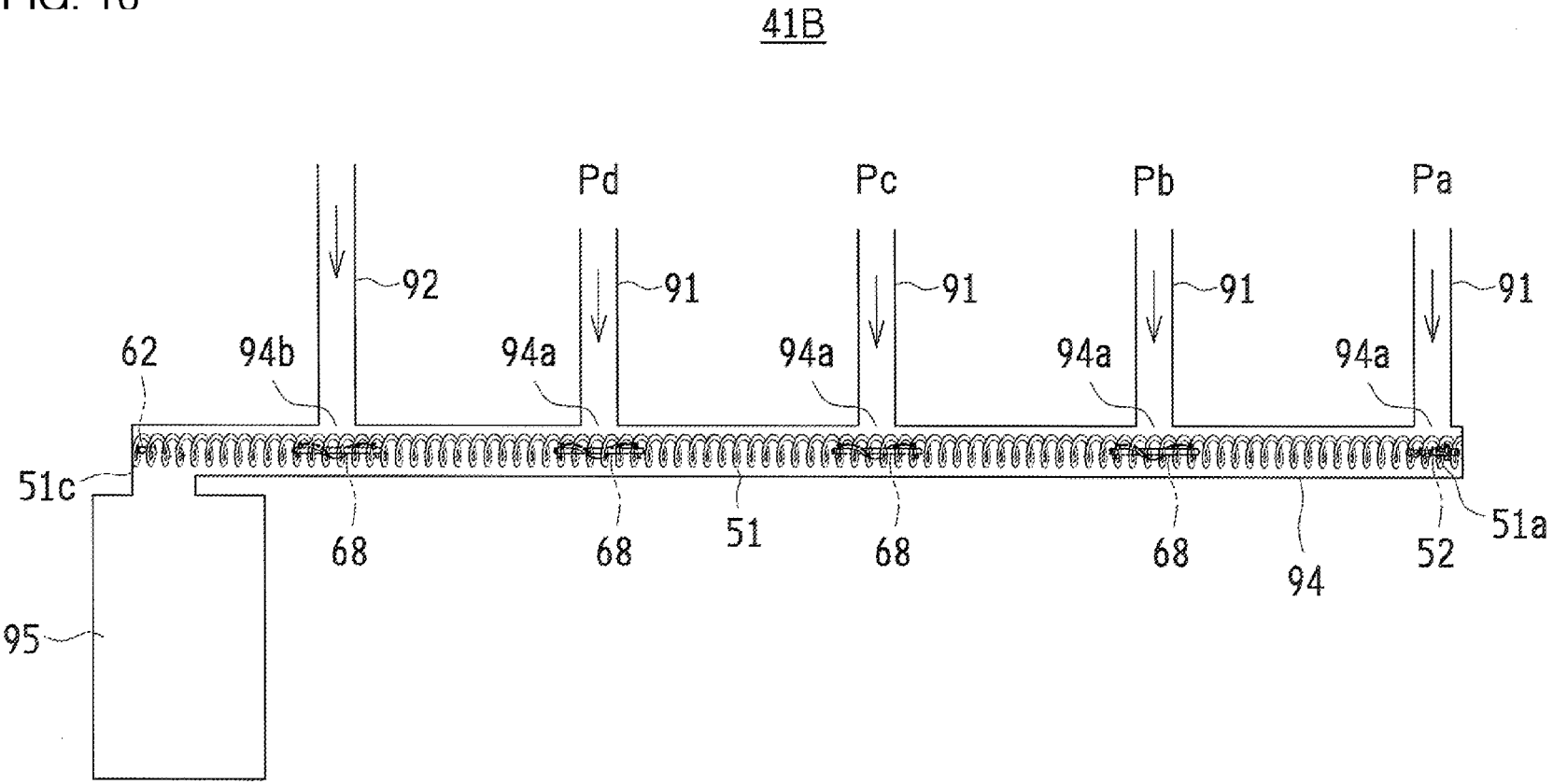
FIG. 16 is a view schematically illustrating the developer conveyance device of the third preferred embodiment of the present invention.

FIG. 16 is a view schematically illustrating the developer conveyance device 41*b* of the third preferred embodiment. As illustrated in FIG. 16, in the developer conveyance device 41B, one spiral coil 51 is rotatably inserted inside the conveyance hose 94. Furthermore, in the opening 94*a* of the conveyance hose 94 communicating with the pipe 91 of the image station Pa, the shaft member 52 is inserted into the one end portion 51*a* of the spiral coil 51. The one end portion 51*a* of the spiral coil 51 is coupled and locked to the shaft member 52, such that the one end portion 51*a* of the spiral coil 51 and the shaft member 52 are rotatably supported. This supporting structure of the one end portion 51*a* of the spiral coil 51 and the shaft member 52 is as described above with reference to FIGS. 4 and 6.

Further, in each of the openings 94*a* of the conveyance hose 94 communicating with each of the pipes 91 of another of the image stations Pb, Pc, and Pd, the screw member 68 is inserted inside the spiral coil 51 and is fixed thereto. Similarly, in the opening 94*b* of the conveyance hose 94 communicating with the pipe 92 of the belt cleaning device 77, the screw member 68 is inserted inside the spiral coil 51 and is fixed thereto. A fixing structure of the screw member 68 to the spiral coil 51 is as described above with reference to FIGS. 12 and 13.

The joint unit 62 is inserted into the other end portion 51*c* of the spiral coil 51, and the other end portion 51*c* of the spiral coil 51 is coupled and locked to the joint unit 62. A locking structure of the joint unit 62 to the other end portion 51*c* of the spiral coil 51 is as described above with reference to FIG. 11.

In the developer conveyance device 41B having this configuration, the joint unit 62 is rotary driven, and the spiral coil 51, the shaft member 52, and each of the screw members 68 are rotary driven in a predetermined direction inside the conveyance hose 94. In this state, when the waste toner is naturally dropped into the opening 94*a* of the conveyance hose 94 through the pipe 91 of the image station Pa, by the spiral coil 51 and by the spiral screw 52*b* of the shaft member 52, the waste toner is sent through the conveyance hose 94 in a direction nearing the waste toner bottle 95. When the waste toner is naturally dropped into each of the openings 94*a* of the conveyance hose 94 through the pipe 91 of another of the image stations Pb, Pc, and Pd, the waste toner is conveyed by the spiral coil 51 and by a spiral screw 68*b* of each of the screw members 68 in a direction nearing the waste toner bottle 95 through the conveyance hose 94. Similarly, when the waste toner is naturally dropped into the opening 94*b* of the conveyance hose 94 through the pipe 92 of the belt cleaning device 77, the waste toner is conveyed by the spiral coil 51 and by the spiral screw 68*b* of the screw member 68 in the direction nearing the waste toner bottle 95 through the conveyance hose 94. Thus, the waste toner discharged to each of the pipes 91 and 92 is naturally dropped into each of the openings 94*a* and 94*b* of the conveyance hose 94 and is conveyed by the spiral coil 51, the spiral screw 52*b* of the shaft member 52, and the spiral screw 68*b* of each of the screw members 68 in the direction nearing the waste toner bottle 95 through the conveyance hose 94.

Then, when the waste toner is conveyed to the joint unit 62 through the conveyance hose 94, since a lower side of the joint unit 62 is opened, the waste toner is discharged from the joint unit 62 to the waste toner bottle 95, where it is recovered.

In the developer conveyance device 41B of the third preferred embodiment as well, the waste toner inside the conveyance hose 45 is quickly conveyed by the spiral coil 51, the spiral screw 52*b* of the shaft member 52, and the spiral screw 68*b* of each of the screw members 68.

The spiral screw 52*b* and each of the spiral screws 68*b* are extended in the direction nearing the waste toner bottle 95 relative to each of the openings 94*a* and 94*b* of the conveyance hose 94. Accordingly, the waste toner is surely conveyed from each of the openings 94*a* and 94*b* to inside of the conveyance hose 94.

In a situation where solidification of the waste toner is progressing, even if the spiral coil 51 is elastically deformed being buried in the waste toner, the spiral screw 52*b* and each of the spiral screws 68*b* are not elastically deformed, such that a conveyance performance of the waste toner by the spiral screw 52*b* and each of the spiral screws 68*b* is maintained, and the solidification of the waste toner is effectively prevented.

Further, a pitch P2 of the spiral screw 52*b* and each of the spiral screws 68*b* is sufficiently longer than pitches P1 and P1*a* of the spiral coil 51, such that a conveyance speed of the waste toner by the spiral screw 52*b* and each of the spiral screws 68*b* is faster than a conveyance speed of the waste toner by the spiral coil 51. Due to a difference between the conveyance speed by the spiral screw 52*b* and each of the spiral screws 68*b* and the conveyance speed by the spiral coil 51, the solidification of the waste toner is more effectively prevented.

Note, however, that in each of the above-described preferred embodiments, the pitch P2 of the spiral screw 52*b* and each of the spiral screws 68*b* is set to be longer than the pitches P1 and P1*a* of the spiral coil 51. However, it is also possible to set such that the pitch P2 is the same as the pitch P1 or the pitch P1*a* or to set such that the pitch P2 is shorter than the pitch P1 or the pitch P1*a*. It is also possible to apply a coil spring in place of a spiral coil.

Further, in each of the above-described preferred embodiments, the developer conveyance device is applied to convey the waste toner. However, it is also possible to apply the developer conveyance device according to various preferred embodiments of the present invention to convey unused toner from a toner cartridge to a developing device.

As above, the preferred embodiments and modifications of the present invention have been described with reference to the attached drawings. However, it is needless to say that the present invention is not to be limited to these examples.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A developer conveyance device, comprising: a spiral coil provided in a conveyance path of a developer and configured to convey the developer by rotating; a shaft member passing through and attached to an end portion of the spiral coil and rotatably supporting the end portion of the spiral coil; and a spiral screw provided on an outer periphery of the shaft member and arranged inside the spiral coil; wherein the spiral coil has a pitch at the end portion that is narrower than a pitch at a center of the spiral coil such that a distance between centers of adjacent coils of the spiral coil is smaller at the end portion than a distance between centers of adjacent coils of the spiral coil at the center.

2. The developer conveyance device according to claim 1, wherein the conveyance path includes a tubular member through which the spiral coil is passed, and the tubular member is provided with an opening in a portion where there is the shaft member.

3. The developer conveyance device according to claim 2, wherein the spiral screw is extended in a direction of conveyance of the developer relative to the opening of the tubular member.

4. The developer conveyance device according to claim 2, wherein a pitch of the spiral coil at the opening is less than a pitch of the spiral screw.

5. An image forming device comprising the developer conveyance device according to claim 1.

* * * * *